US005864992A

United States Patent [19]

Bigelow

[11] Patent Number: 5,864,992

[45] Date of Patent: Feb. 2, 1999

[54] ROOF AND PORTABLE BUILDING

[76] Inventor: William H. Bigelow, P.O. Box 7064, Houston, Tex. 77248-7064

[21] Appl. No.: 887,167

[22] Filed: Jul. 2, 1997

[51] Int. Cl.[6] ..... E04B 7/02

[52] U.S. Cl. ..... 52/90.1; 52/92.1

[58] Field of Search ..... 52/90.1, 92.1, 52/92.3, 93.1, 93.2

[56] References Cited

U.S. PATENT DOCUMENTS

| | | | |
|---|---|---|---|
| 758,033 | 4/1904 | Holmes | 52/90.1 X |
| 2,633,610 | 4/1953 | Hervey . | |
| 3,241,273 | 3/1966 | Struben | 52/90.1 X |
| 4,122,639 | 10/1978 | Barrell | 52/92.1 |
| 4,327,529 | 5/1982 | Bigelow, Jr. et al. | 52/34 |
| 4,364,206 | 12/1982 | Wybauw | 52/79.7 |
| 4,470,227 | 9/1984 | Bigelow, Jr. et al. | 52/79.1 |
| 4,574,533 | 3/1986 | Bigelow, Jr. et al. | 52/34 |
| 4,637,179 | 1/1987 | Bigelow, Jr. et al. | 52/79.5 |
| 4,901,484 | 2/1990 | Santosuosso | 52/93.1 |
| 5,349,793 | 9/1994 | Bigelow, Jr. | 52/143 |
| 5,491,934 | 2/1996 | Bieglow et al. | 52/79.5 |
| 5,634,315 | 6/1997 | Toya | 52/741.1 |
| 5,653,459 | 8/1997 | Murphy | 280/166 |
| 5,660,005 | 8/1997 | Tacoma | 52/93.2 |

*Primary Examiner*—Creighton Smith
*Attorney, Agent, or Firm*—Guy McClung

[57] ABSTRACT

A roof structure for a building has been invented which includes a roof support having an outer edge, and a roof covering on the roof support, the roof covering having a lower lip projecting inwardly beneath the outer edge of the roof support. The roof structure in one aspect has interconnected sides having an outer surface and an inner surface, and the roof covering covers the outer surfaces of the sides of the roof support and at least a portion of the inner surfaces of the sides of the roof support. A building has been invented with such a roof structure and a method has been invented to emplace such a roof structure on upright walls of a building.

16 Claims, 4 Drawing Sheets

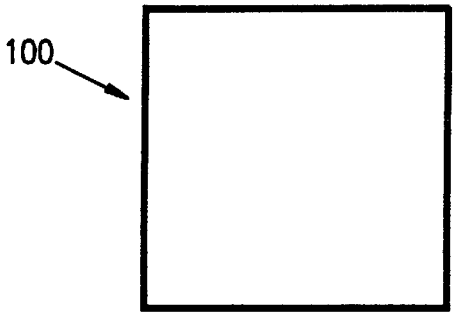
FIG. 3A
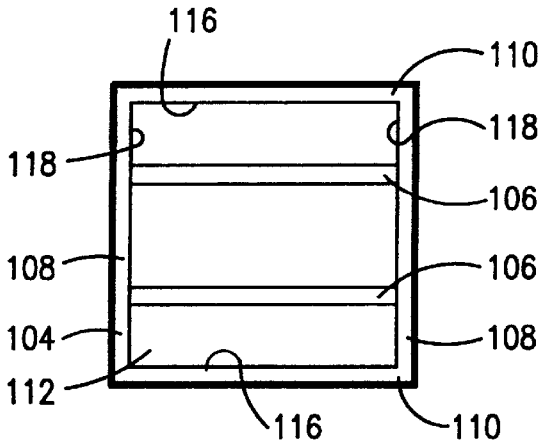
FIG. 3B
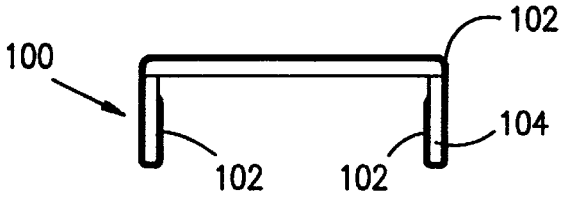
FIG. 3C
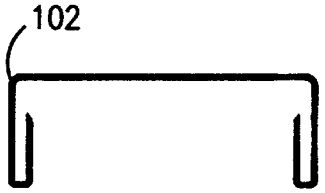
FIG. 3D
FIG. 3E
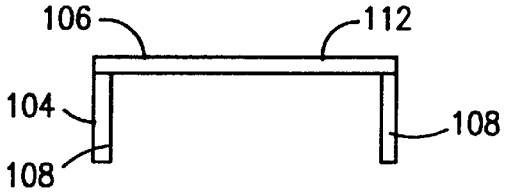
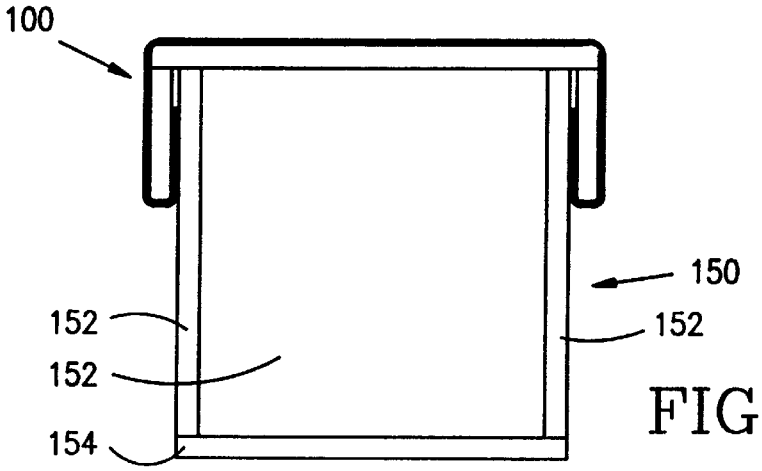
FIG. 4

ROOF AND PORTABLE BUILDING

BACKGROUND OF THE INVENTION

1. Field of the Invention

This invention is directed to roofs for buildings; roofs for portable buildings; integral roofs for buildings; and buildings with such a roof.

2. Description of Related Art

The prior art discloses a variety of portable buildings and buildings assembled from prefabricated building elements.

It is known in the art to place a single-piece roof structure or truss system on the walls of a portable building and to secure it to the walls. It is known in the art to cover the top and outer sides of such a roof structure with a layer or membranes of protective material such as rubber, rubber roof membrane, flexible plastic, elastomeric material, and fiberglass. Prior art roof trusses are made of metal (e.g. aluminum or steel), wood, fiberglass or some combination thereof.

In certain prior art systems, one or several pieces or panels of roof covering or "membrane" material are installed on top of a roof; and, when multiple pieces are used, to join and seal them together. Such roof coverings are secured to the underlying roof by adhesives, or other suitable fasteners. In certain prior art systems a fiberglass covering is applied on a roof.

With prior art roof systems, the edges or joints between a roof covering and an underlying roof are sealed with a separate member (e.g. a flashing or batten). The top edges of vertical walls on which the roof is to be positioned are, in certain prior art systems, covered with a protective apron. With other prior art roof structures a metal plate is used on the top outer edge of the structure to seal abutting members used to make the roof structure. In one prior art system a trough or support is attached around the vertical walls and a lower edge of the roof is received and held in the trough or support.

In various prior art systems interfaces between roof and walls and between roof holders or supports and a roof need to be sealed, often requiring the use of an additional member. The use of roof holders, e.g. "J" rails, requires the emplacement and attachment of the "J" rails to the walls.

There has long been a need for an efficient and effective roof for portable buildings. There has long been a need for such a roof that has protected edges and which does not present roof/wall sealing problems. There has long been a need for a simple roof structure that also seals a roof/wall interface.

SUMMARY OF THE PRESENT INVENTION

The present invention, in certain embodiments, discloses a roof structure for a building (including, but not limited to a portable building and/or a building made of prefabricated elements) that includes a plurality of walls; roof support or truss; a top roof member or members on the roof truss; and a roof covering that covers the top roof member, the sides or "apron" of the roof truss, and which at least wraps under a bottom edge of the roof truss both to protect the roof truss and to enhance securement of the roof covering on the roof truss. In one aspect the roof covering wraps over the lower roof edge and extends up on the apron's interior surface. In another aspect such an extending portion of the roof covering serves as a sealing gasket between the roof and the upper portion of the walls.

In one aspect the roof covering is a single piece of flexible material or fabric or is an integral unit applied on the roof truss. In another aspect the roof covering is made of a series of panels, pieces sections, e.g. of rubber, plastic, fiberglass or rubber roof membrane that are arranged side-by-side on top of the roof truss and then sealed together at their abutting edges and glued on the top roof member and on the apron of the roof truss. In one aspect at least part of the apron's interior surface is covered by the material.

In one aspect, a lower overlapping edge of the roof covering that projects beneath the bottom of the roof truss system may be farther secured to the roof truss system or to the walls with appropriate nails, staples, screws, bolts, or other fasteners.

In one aspect the roof material is flexible rubber, flexible synthetic material, flexible plastic, flexible fiberglass, rubber roof membrane material whose thickness ranges between 0.025 and 1.00 inches. In one particular embodiment a single piece of rubber roof membrane about 0.065 inches thick is used to cover the entire top deck of a truss and the sides or apron.

The present invention also discloses a method for applying a roof covering to a roof truss and for repairing such a roof covering. The roof material is attached or glued on the top and on outer sides of the roof apron with any suitable adhesive as well as on an inner portion of the sides or apron. Known repair methods for repairing holes or cuts in rubber, plastic, synthetic material, or fiberglass are used to repair such damage to the roof material. Known seam connection, adhering or welding techniques are used to connect and seal seams when multiple pieces are used. Electrical and/or air conditioning conduits and ducts may be disposed in the roof truss.

The present invention discloses, in certain embodiments, a building with a floor, walls connected to the floor, and any new roof structure as described herein secured to the walls.

The present invention discloses, in certain embodiments, a roof structure for a building, the roof structure having a roof support having an outer edge, and a roof covering on the roof support, the roof covering having a lower lip projecting inwardly beneath the outer edge of the roof support; such a roof structure wherein the outer edge of the roof support comprises two pairs of opposed edges; such a roof structure wherein the roof covering covers some or substantially all of the roof support, in one aspect all exterior surfaces and some or all of the interior surfaces; such a roof structure wherein the walls have top ends disposed within the roof support and the roof covering has inner ends disposed between a top interior surface of the roof support and the top ends of the walls; such a roof structure wherein the roof support is a truss with a top member, a bottom member, side members interconnected between the top and bottom members, and, optionally, intermediate supports extending between the side members; such a roof structure wherein the roof covering is made of rubber roof membrane material; such a roof support wherein the roof covering is about 0.05 inches thick, about 0.65 inches thick or ranges in thickness between about 0.025 about 0.085 inches; such a roof structure wherein the roof support is positionable on upright walls of a building with top portions of the walls within the roof support, and wherein the side members have lower ends, the roof structure also having protectors covering at least a portion of the lower ends, such in one aspect protectors also disposable such that and of a small enough thickness that they facilitate the emplacement of the roof structure over upright walls of a building and/or prevent snagging of the roof material during emplacement; such a roof structure wherein the lower lip is secured to the roof support by at least one fastener passing through the roof covering and into the roof support; such a roof structure wherein the roof support has interconnected sides having an outer surface and an inner surface, and the roof covering covers the outer surfaces of the sides of the roof support and at least a portion of the inner surfaces of the sides of the roof support, or substantially all thereof.

The present invention, in certain embodiments, discloses a roof structure for a building, the roof structure having a roof support having an outer edge, and a roof covering of roof material on the roof support, the roof covering having a lower lip projecting downwardly past a lower edge of the roof support, in one aspect for attachment to a part of a wall or inwardly beneath the outer edge of the roof support, the outer edge of the roof support having at least two pairs of opposed edges, and wherein the roof covering covers and is glued to some or all of the roof support; such a roof structure wherein the roof support has interconnected sides having an outer surface and an inner surface, and the roof covering covers the outer surfaces of the sides of the roof support and at least a portion of the inner surfaces of the sides and or ceiling of the roof support.

The present invention discloses, in certain embodiments, a building with a plurality of interconnected walls defining an interior space therebetween, an optional floor on which the walls are positioned, and a roof structure connected on top of the walls, the roof structure having a roof support having an outer edge, and a roof covering on the roof support, the roof covering having a lower lip projecting inwardly toward the walls beneath the outer edge of the roof support or downwardly past a lower end of the roof structure; such a building wherein the outer edge of the roof support has at least two pairs of opposed edges and the roof covering lower lip is positioned adjacent to and beneath the two pairs of opposed edges; such a building wherein the roof covering covers the roof support; such a building wherein the walls have top ends disposed within the roof support and the roof covering has inner ends disposed between a top interior surface of the roof support and the top ends of the walls; such a building wherein the roof support is a truss with a top member, a bottom member, side members interconnected between the top and bottom members, and optional intermediate supports extending between the side members; such a building wherein the roof support is positionable on upright walls of a building, with top portions of the walls within the roof support, and wherein the side members have lower ends, the roof structure also having protectors covering at least a portion of the lower ends, angle pieces, and/or attachment pieces conected to the roof support for holding the roof material, for facilitating emplacement of a roof stucture on walls, for serving as a seal and/or gasket, an/or for preventing snagging of roof material; such a building wherein the roof support has interconnected sides having an outer surface and an inner surface, the roof covering covers the outer surfaces of the sides of the roof support and at least a portion of the inner surfaces of the sides of the roof support, each wall having a top portion within the sides of the roof support, and the roof covering acting as a sealing gasket between the inner surfaces of the sides of the roof support and the top portion of the walls.

The present invention, in certain embodiments, discloses a method for connecting a roof structure and walls of a building structure, the method including positioning a roof structure above the interconnected walls of a building structure, the roof structure having a roof support with interconnected sides having an outer surface and an inner surface, a roof covering that covers the outer surfaces of the sides of the roof support and at least a portion of the inner surfaces of the sides and/or ceiling of the roof support, each wall having a top portion within the sides of the roof support, and lowering the roof structure onto the walls with a sealing fit so that a portion of the roof covering is disposed between the inner surfaces of the sides of the roof support and the top portion of the walls. In one aspect the roof amterial of the roof covering itself acts as a seal and/or gasket. In another aspect protectors, angle pieces, and/or attachment pieces as described above and herein are used in such methods.

It is, therefore, an object of at least certain preferred embodiments of the present invention to provide:

New, useful, unique, efficient, nonobvious devices and methods for roof structures for buildings, methods for their use and installation, and buildings with such a roof structure;

Such a roof structure with a roof covering lower edge that overlaps and covers an outer bottom edge of a roof apron or bottom of an outer side of a roof truss; covers a portion of a wall; and/or in one aspect, covers a portion or all of the inner surface of the roof side or apron;

Such a roof structure with such a roof covering that is adhesively adhered to the roof truss;

Such a roof structure with a flexible covering extending up into the structure's interior which serves as a sealing gasket and/or shock absorber between the roof structure and the walls;

Such a roof structure that eliminates the need for seals, seam covers, or flashings at certain locations on a building, including, but not limited to, at roof/wall interfaces;

Such a roof structure with an easily repairable roof covering; and

A building with any such roof structure and/or any such roof covering.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one skilled in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

FIG. 3A is a top view of a roof structure according to the present invention;

FIG. 3B is a bottom view of the roof structure of FIG. 3A; and

FIG. 3C is a cross-sectional view of the roof structure of FIG. 3A.

FIG. 3D shows the roof covering of the roof structure of FIG. 3A and

FIG. 3E shows the roof truss of the roof structure of FIG. 3A.

FIG. 4 is a side cross-sectional view of a building according to the present invention with a roof structure as in FIG. 3A.

DESCRIPTION OF EMBODIMENTS PREFERRED AT THE TIME OF FILING FOR THIS PATENT

Figure 1A:
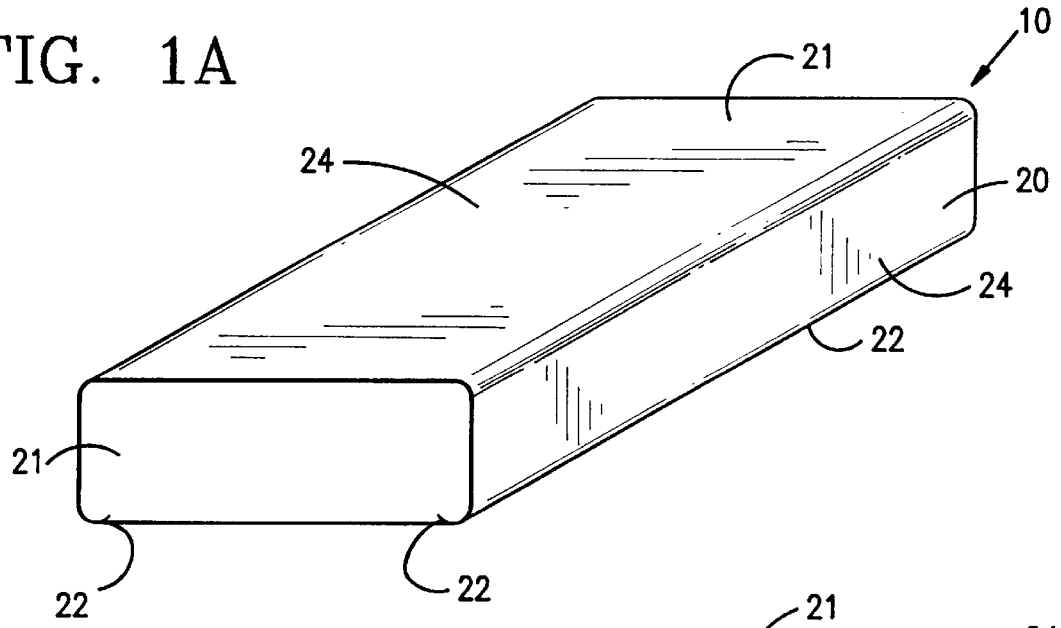
FIG. 1A is a perspective view of roof structure according to the present invention.
Figure 1B:
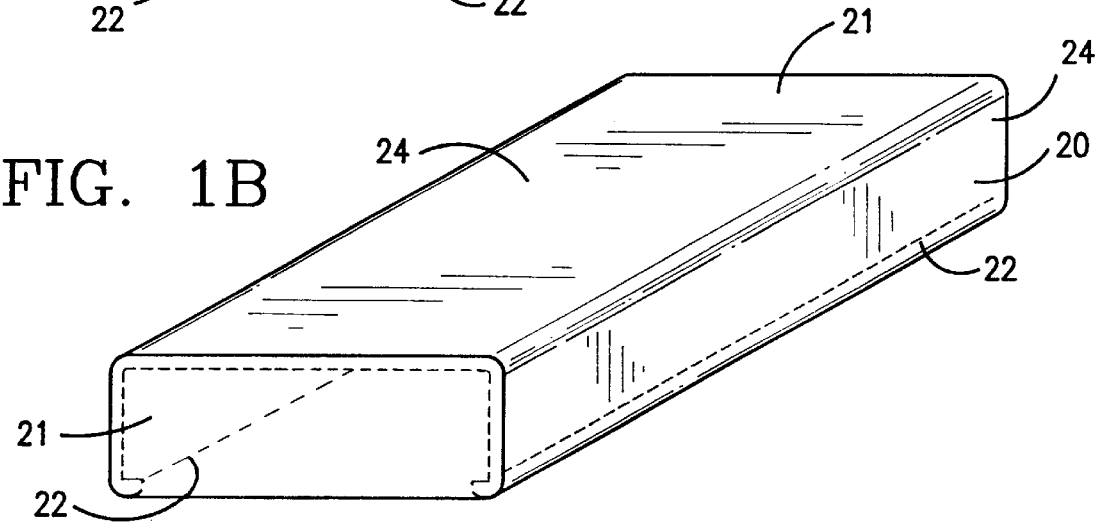
FIG. 1B is a perspective view of a roof covering according to the present invention.

FIG. 1A shows a roof structure 10 according to the present invention with a roof covering 20 and a roof truss 30 therein. The roof covering 20 has ends 21 and lower lips 22 that project in from opposed sides 24 beneath a bottom 32 of the roof truss 30. A top 26 spaces apart the sides 24. The roof covering 20 is a single piece made separately that is placed on and then glued to the roof truss 30.

In another embodiment the roof covering 20 is initially made up of separate pieces of material placed on the top and sides of the roof truss 30. Edges of the pieces are sealed or welded together to form an integral covering.

Figure 1C:
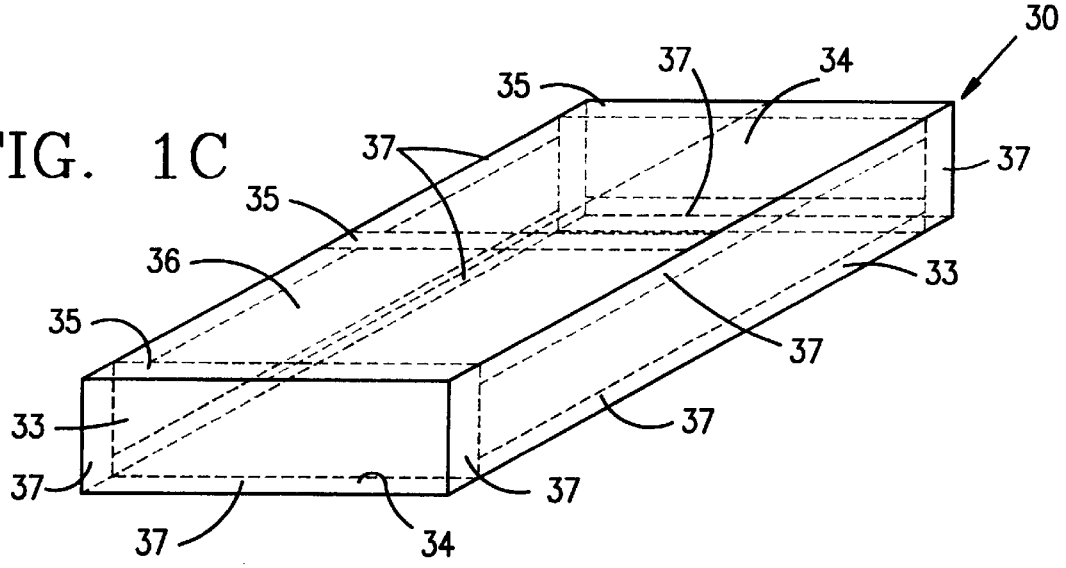
FIG. 1C is a perspective view of a roof truss according to the present invention.

The roof truss 30, FIG. 1C (which is within the roof covering 20 in FIG. 1A), has sides or aprons 33, ends 34, internal rafters 35 and supports 37, and a top member 36. In one aspect the top member 36 is eliminated.

The lip 22 may be larger or smaller than shown. It is within the scope of this invention for the lip to project inwardly to contact a building wall and, in one aspect, to extend downwardly to cover part of the wall. Alternatively, part of the roof covering 20 may extend upwardly between the roof truss 30 and a wall of a building. The roof covering 20 may be any desired thickness and, in certain preferred embodiments, ranges between 0.025 inches and 1.00 inches thick. In one particular embodiment the roof covering 20 is commercially available rubber roof membrane material about 0.065 inches thick.

As shown the ends 34 of the roof truss 30 are covered by the roof covering 20. It is, however, within the scope of this invention for the roof covering not to cover the ends 34 or to partially cover them. Alternatively, separate pieces of membrane material may be applied to the ends 34. In one aspect such pieces are sealingly joined at their edges to the roof covering 20.

Figure 2A:
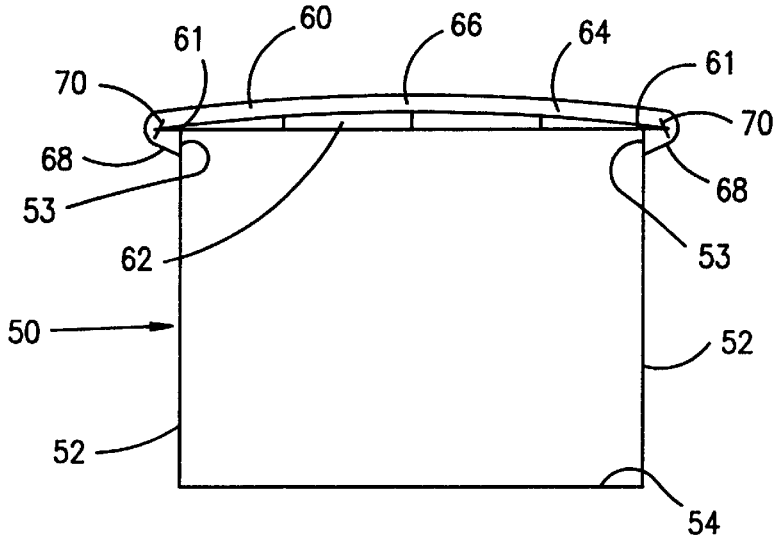
FIG. 2A is a cross-section view of a building as shown in FIG. 2B.
Figure 2B:
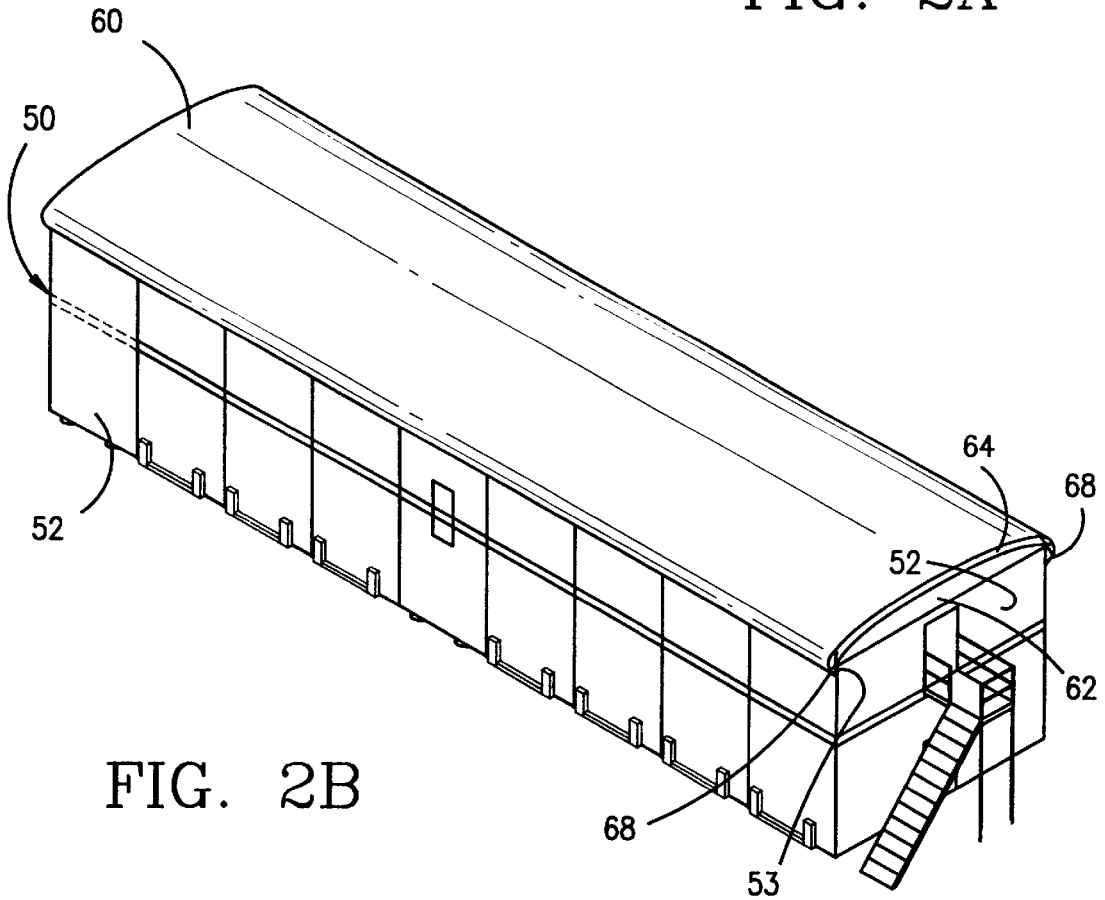
FIG. 2B is a perspective view of a building according to the present invention.

FIG. 2A shows a building 50 according to the present invention with walls 52 (two shown); a floor 54; and a roof system 60 according to the present invention.

The roof system 60 has a truss 62 and a roof covering 64 on the truss 62. The roof covering 64 has a roof member 66 and lower lips 68 that project beneath edge members 61 of the truss 62. The lips 68 also extend down over and are glued to a top portion 53 of the walls 52. Screws 70 (or other suitable fasteners) are used to secure the roof covering 64 to the truss 62. Such fasteners may also extend through the lips 68 into the walls 52. Alternatively, or in addition to the screws 70, adhesive may be used.

FIG. 3A shows a top view of a roof structure 100 according to the present invention covered by flexible roof covering material 102. FIG. 3B is a bottom view of a truss 104 used beneath the roof covering material 102 of the roof structure 100. The truss 104 has a top 112, interconnected sides 108 and 110, and cross-supports or rafters 106.

FIG. 3C is a cross-sectional view through the roof structure 100 (showing both a vertical and a horizontal view through the roof structure 100 as shown in FIG. 3A). The roof covering 102 covers the top 112 of the truss 104, its sides 108 and 110 and a portion of inner side surfaces 116 and 118. It is within the scope of this invention for the covering to cover only one inner side surface or any two opposed inner side surfaces.

FIG. 3D shows a cross-sectional view of the roof covering of the roof structure of FIG. 3A. FIG. 3E shows a cross-sectional view of the roof truss of the roof structure of FIG. 3A.

In addition to the use of flexible material, flexible plastic, flexible fiberglass, or flexible fabric for any roof covering herein, alternatively any suitable spray-on water-repellent material may be used to produce a roof covering according to the present invention.

FIG. 4 shows a building 150 (in cross section) with a roof structure 100. The building 150 has four walls 152 (three shown) and a floor 154. An upper portion of the walls is in contact with a portion of the roof covering 102 disposed between an exterior of the walls and an interior of the roof truss 104. This portion of the roof covering serves as a sealing gasket between the walls 152 and the roof structure 100.

Figure 5A:
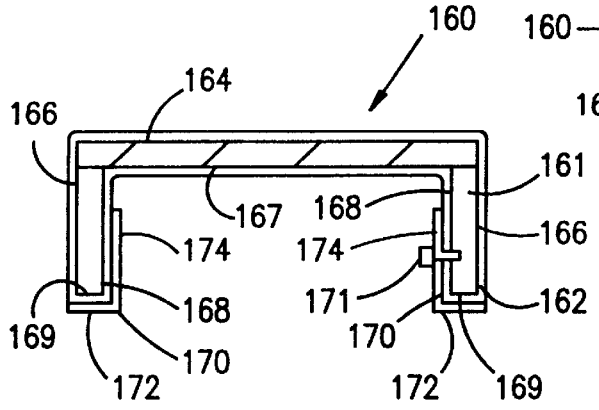
FIG. 5A is a side cross-section view of a roof structure according to the present invention.
Figure 5B:
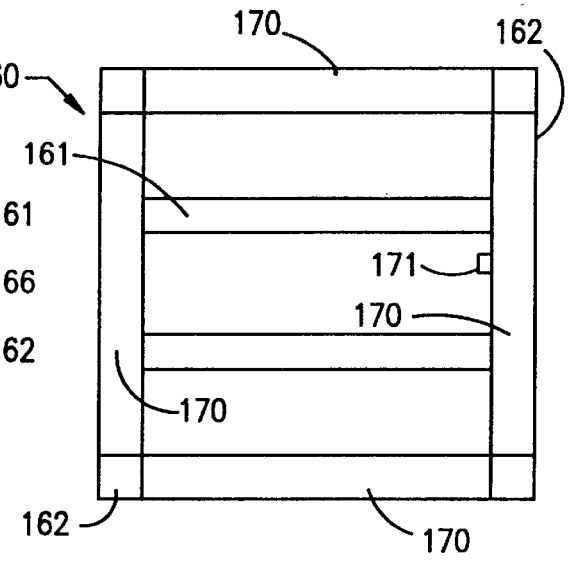
FIG. 5B is a bottom view of the roof structure of FIG. 5A.

FIGS. 5A and 5B show a roof structure 160 like that in FIG. 4 with a truss 161, but with flexible plastic, fiberglass, fabric, or rubber roof membrane material 162 (preferably water-repellent) (collectively "roof material") covering both the exterior surfaces (top 164, sides 166) and the interior surfaces (ceiling 167, sides 168) as well as the lower ends 169 of the sides. Another difference is the use of L-shaped protectors 170 with a lower flat part 172 over the ends 169 of the roof structure 160 and an upper vertical part 174 on the interior sides 168. As shown in FIG. 5B, the protectors 170 cover all the lower end surfaces with the exception of the corners. It is within the scope of this invention for the protectors 170 or for any of the protectors 170 to extend over only a portion of a lower end 169. It is also within the scope of this invention to glue or fasten a solid protective piece on the uncovered corners (see FIG. 5B). Alternatively, the upper verticle part 174 of any of all of the protectors 170 may be on the outside of the roof structure 160.

The protectors 170 (and any protector or angle piece in FIGS. 5A–8B) to be made of a suitable thickness that will not interfere with the emplacement of a roof structure on the walls of a building and to be made of any suitable solid, tape, or foil material, including, but not limited to, aluminum sheet or foil, flat fiberglass pieces, sheet metal, or plastic. The protectors may be glued on (see, e.g., the protector 170 on the left side of FIG. 5A) or they may be attached with a fastener (see, e.g., the screw 171 through the protector 170 on the right side of FIG. 5A). Appropriate adhesives or adhesive tape may also be used to hold the protectors in place. In one aspect the protectors or angle pieces may be thinner than the roof material.

Figure 6:
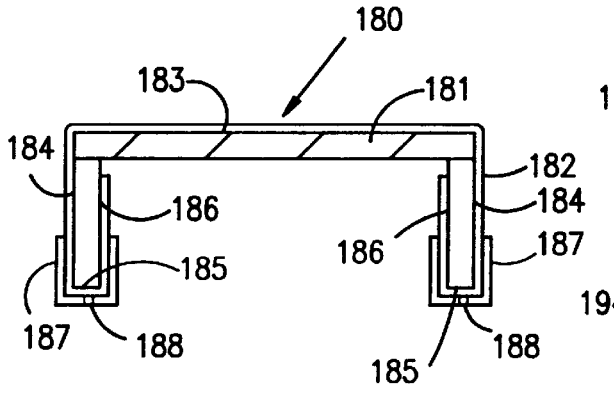
FIG. 6 is a side cross-section view of a roof structure according to the present invention.

FIG. 6 shows a roof structure 180 according to the present invention with a truss 181 and roof membrane material 182 covering the exterior surfaces (top 183, sides 184, ends 185) and a portion of the interior surface (sides 186). U-shaped protectors 187 cover the ends 185 and extend all around the roof structure 180 (as do the protectors 170 in FIG. 5B). For fluid drainage, the protectors 187 may have one or more holes 188. FIGS. 5A–8B are schematic and the thicknesses of various items shown are merely illustrative. Any suitable thickness of roof membrane material or of protector material may be used. The protectors 170 have two members at a right angle to each other and the protectors 187 have three members. It is within the scope of this invention for the protectors (and angle pieces, FIG. 7) to be integral pieces or made up of separate pieces each individually adhered to, attached to, and/or connected to (e.g. with fasteners or Velcro™ material). From below, the roof structures of FIGS. 6–8A look like that of FIG. 5B (or any of them may be rectangular, trapezoidal, circular, triangular or any desired shape).

Figure 7:
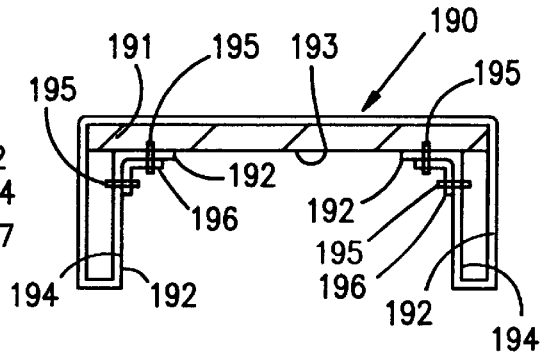
FIG. 7 is a side cross-section view of a roof structure according to the present invention.

FIG. 7 shows a roof structure 190 according to the present invention with a truss 191 covered exteriorly and partially interiorly with flexible roof material 192. Attached to a ceiling 193 and interior sides 194 with screws 195 are angle pieces 196. The screws 195 extend through the roof material 192. Instead of, or in addition to the screws, suitable adhesives and/or tape may be used. The angle pieces may be the length of the interior sides or some shorter length. If the length is shorter, one, two, three, four or more may be used on each side. The protectors, angle pieces, and attachment peices disclosed herein may be the same thickness as the roof material or they may be thicker or thinner than the roof material.

Figure 8A:
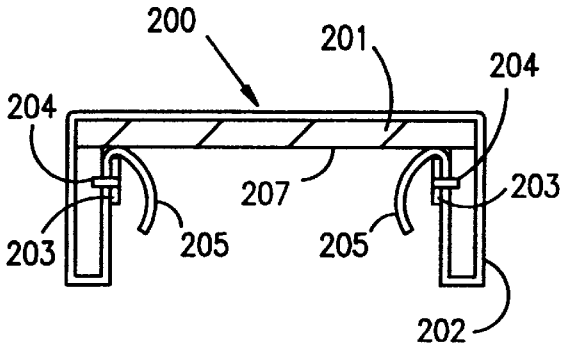
FIG. 8A is a side cross-section view of a roof structure according to the present invention.
Figure 8B:
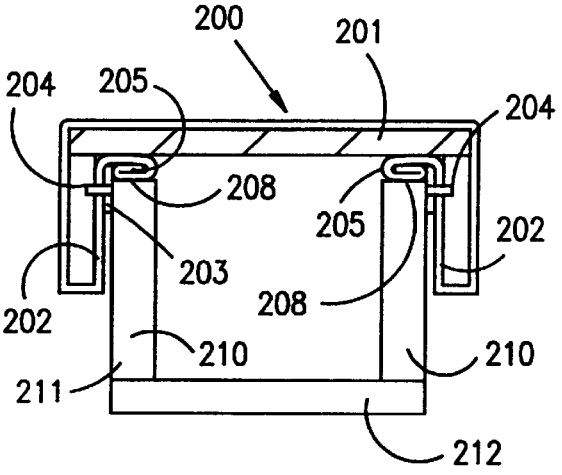
FIG. 8B is a side cross-section view showing the roof structure of FIG. 8A on a building according to the present invention.

FIGS. 8A and 8B show a roof structure 200 according to the present invention with a truss 201 and roof material 202. End portions 205 of the roof material 202 hang over attachment pieces 203 adhered to the roof material and/or affixed to the truss sides with screws 204. As shown in FIG. 8B, the end portions 205 are disposed between a lower surface 207 of the truss 201 and upper ends 208 of walls 210 of a building 211 having a floor 212. The end portions 205 serve as a gasket and/or seal. The attachment pieces may be any suitable solid, soft, or flexible material and may also serve as a gasket or seal between the roof structure and walls. The building 211 represents any building suitable for emplacement thereon of a roof structure 200. The roof material 202 may be any desired thickness and the end portions 205 may be any desired length, i.e., the end portions 205 may extend beyond the top of the attachment pieces 203 any desired length. Alternatively, one, two, three, four or more thicknesses of the roof material 202 may be folded on themselves and secured to the lower surface 207 of the truss 201 to serve as a seal and/or gasket.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112.

What is claimed is:

1. A roof structure for a building, the roof structure comprising a roof support having an outer edge, the roof support comprising a truss with a top member, a bottom member, and side members interconnected between the top and bottom members, each side member having an outer surface and an inner surface, a roof covering on the roof support, the roof covering covering the outer surfaces of the sides of the truss and at least a portion of the inner surfaces of the sides of the truss, and the roof covering on at least a portion of the inner surfaces of the sides of the truss sized and disposed to act as a seal against exterior sides of walls of a building on which the roof structure is positioned.

2. The roof structure of claim 1 wherein the roof covering is made of rubber roof membrane material.

3. The roof structure of claim 1 wherein the side members have lower ends, the roof structure further comprising protectors outside the roof covering, the protectors over at least a portion of the lower ends and secured thereto.

4. The roof structure of claim 3 wherein the protectors are made from materials from the group consisting of aluminum sheet, aluminum foil flat fiberglass, sheet metal, and plastic.

5. The roof structure of claim 1 wherein a portion of the roof covering hangs from the interior of the roof support for positioning between top ends of walls of a building on which the roof structure is positioned and an inner bottom surface of the roof support to serve as a seal therebetween.

6. The roof structure of claim 1 wherein the roof covering is glued to the roof support.

7. The roof structure of claim 1 wherein the roof covering is between 0.025 and 1.00 inches thick.

8. The roof structure of claim 1 wherein the roof covering is rubber roof membrane material about 0.065 inches thick.

9. A building comprising a plurality of interconnected walls defining an interior space therebetween, each wall having a top end and an exterior side, a floor on which the walls are positioned, and a roof structure connected to the walls, the roof structure comprising a roof support having an outer edge, the roof support comprising a truss with a top member, a bottom member, and side members interconnected between the top and bottom members, each side member having an outer surface and an inner surface, a roof covering on the roof support, the roof covering covering the outer surfaces of the sides of the truss and at least a portion of the inner surfaces of the sides of the truss, and the roof covering on at least a portion of the inner surfaces of the sides of the truss sized and disposed to act as a seal against the exterior sides of the walls.

10. The building of claim 9 wherein the roof covering is made of rubber roof membrane material.

11. The building of claim 9 wherein the roof covering covers the roof support.

12. The building of claim 9 wherein the protectors are made from materials from the group consisting of aluminum sheet, aluminum foil flat fiberglass, sheet metal, and plastic.

13. The building of claim 9 wherein a portion of the roof covering hangs from the interior of the roof support for positioning between the top ends of the walls and an inner bottom surface of the roof support to serve as a seal therebetween.

14. The building of claim 9 wherein the roof support is positionable on the walls with top portions of the walls within the roof support, and wherein the side remembers have lower ends, the roof structure further comprising protectors outside the roof covering and over at least a portion of the lower ends and secured thereto.

15. The building of claim 9 wherein the roof covering is rubber roof membrane material that covers the outer surfaces of the sides of the roof support and at least a portion of the inner surfaces of the sides of the roof support.

16. A method for connecting a roof structure and interconnected walls of a building structure, each wall having an exterior side, the method comprising positioning a roof structure above the interconnected walls of the building structure, the roof structure comprising a roof support having an outer edge, the roof support comprising a truss with a top member, a bottom member, and side members interconnected between the top and bottom members, each side member having an outer surface and an inner surface, a roof covering on the roof support, the roof covering covering the outer surfaces of the sides of the truss and at least a portion of the inner surfaces of the sides of the truss, and the roof covering on at least a portion of the inner surfaces of the sides of the truss sized and disposed to act as a seal against the exterior sides of the walls, and lowering the roof structure onto the walls with a sealing fit so that a portion of the roof covering is disposed between the inner surfaces of the sides of the roof support and the exterior sides of the walls providing a seal therebetween.

* * * * *